United States Patent [19]

West

[11] Patent Number: 4,833,852

[45] Date of Patent: May 30, 1989

[54] INSULATING SYSTEM FOR BUILDING BLOCKS

[76] Inventor: Earl L. West, 17990 Ixonia Ave. W., Lakeville, Minn. 55044

[21] Appl. No.: 63,827

[22] Filed: Jun. 19, 1987

Related U.S. Application Data

[63] Continuation of Ser. No. 667,975, Nov. 5, 1984, abandoned, which is a continuation-in-part of Ser. No. 609,878, May 14, 1984.

[51] Int. Cl.[4] ..... E04B 2/00

[52] U.S. Cl. ..... 52/405; 52/407; 52/396

[58] Field of Search ..... 52/405, 407, 408, 309.12, 52/606, 396

[56] References Cited

U.S. PATENT DOCUMENTS

| | | | |
|---|---|---|---|
| 1,884,319 | 10/1932 | Smith | 52/405 |
| 3,653,170 | 4/1972 | Shecklee | 52/405 X |
| 3,982,369 | 9/1976 | Keleske | 52/407 |
| 4,269,013 | 5/1981 | West | 52/405 |
| 4,348,845 | 9/1982 | Iannarelli | 52/405 |
| 4,498,266 | 2/1985 | Perreton | 52/405 |

*Primary Examiner*—David A. Scherbel
*Assistant Examiner*—Creighton Smith
*Attorney, Agent, or Firm*—John W. Adams

[57] ABSTRACT

An integrally formed insulating insert unit made from insulating material for insertion into a building block cavity and having a main body having a length and depth substantially equal to the respective length and depth dimensions of the block cavity and provided with an upwardly-extending capping flange integrally formed with the top of the main body, a top capping flange integrally formed with the top of the main body and extending thereabove and extending longitudinally outwardly beyond at least one of the upstanding side edges of the body to overlie in sealing engagement the adjacent top web surface of the block and being of sufficient length and thickness and being sufficiently yieldable to produce a vertically and horizontally continuous insulating barrier within a multiple layer masonry block wall section.

6 Claims, 4 Drawing Sheets

INSULATING SYSTEM FOR BUILDING BLOCKS

REFERENCE

This is a continuation of application Ser. No. 667,975 filed Nov. 5, 1989, now abandoned, which is a continuation-in-part of my presently pending application entitled INSULATING SYSTEM FOR BUILDING BLOCKS, filed in the United States Patent and Trademark office on May 14, 1984 as Ser. No. 608,878.

BACKGROUND OF THE INVENTION

With the advent of "rigid" insulating materials such as expanded polystyrene and the like, a large number of different insulating systems for concrete block walls have been developed. These include the systems disclosed in the following U.S. Pat. Nos.:

4,348,845—Iannarelli
4,269,013—West
4,193,241—Jensen, et al.
4,148,166—Toone
4,058,948—Warren
4,015,387—Tillie
3,982,369—Keleske
3,885,363—Whittey
3,546,833—Perreton
3,318,062—Grants
3,204,381—Perreton
2,852,934—Amundson While a number of the patents listed above disclose insert members which are intended to provide the necessary insulation within the block cavities, none of the references shows the unitary construction specifically designed for individual insertion into each cavity, provided with a specific sealing construction designed to provide a crushable, yieldable sealing surface.

Applicant's prior U.S. Pat. No. 4,269,013 discloses an insulating system which incorporates the use of a separate cap element which has proved to be somewhat troublesome in the installation of the complete insulating barrier within the respective block cavities. The present construction of the cap elements integrally with the main body portion of the barrier panels produces a unit which can be quickly and easily installed on the job and which maintains the position of the capping flange during the laying of the next course of blocks.

SUMMARY OF THE INVENTION

The present invention embodies an integrally-formed unitary construction for an insulating member insertable into the cavity of a concrete block and specifically designed to provide sealing engagement with the inside wall surfaces of the cavity, and having an insulating top capping flange integrally formed therewith and extending above the top surface of each block a distance approximately equal to the prescribed thickness of the mortar joint between adjacent block rows and extending outwardly over the block webs to abut a similar capping flange of the insulating insert installed in the adjacent block cavity to form a continuous insulating barrier seal between adjacent rows of blocks.

The present unitary construction of the barrier insert member including the top capping flange provides for material cost savings in the construction of the unit as well as the installation labor when compared with applicant's prior invention disclosed in U.S. Pat. No. 4,269,013, while still providing the continuous barrier seal both horizontally and vertically within the entire block wall section while also permitting reinforcing steel to be inserted between adjacent block layers.

DETAILED DESCRIPTION OF THE EMBODIMENTS OF THE INVENTION IN THE DRAWINGS

Figure 1:
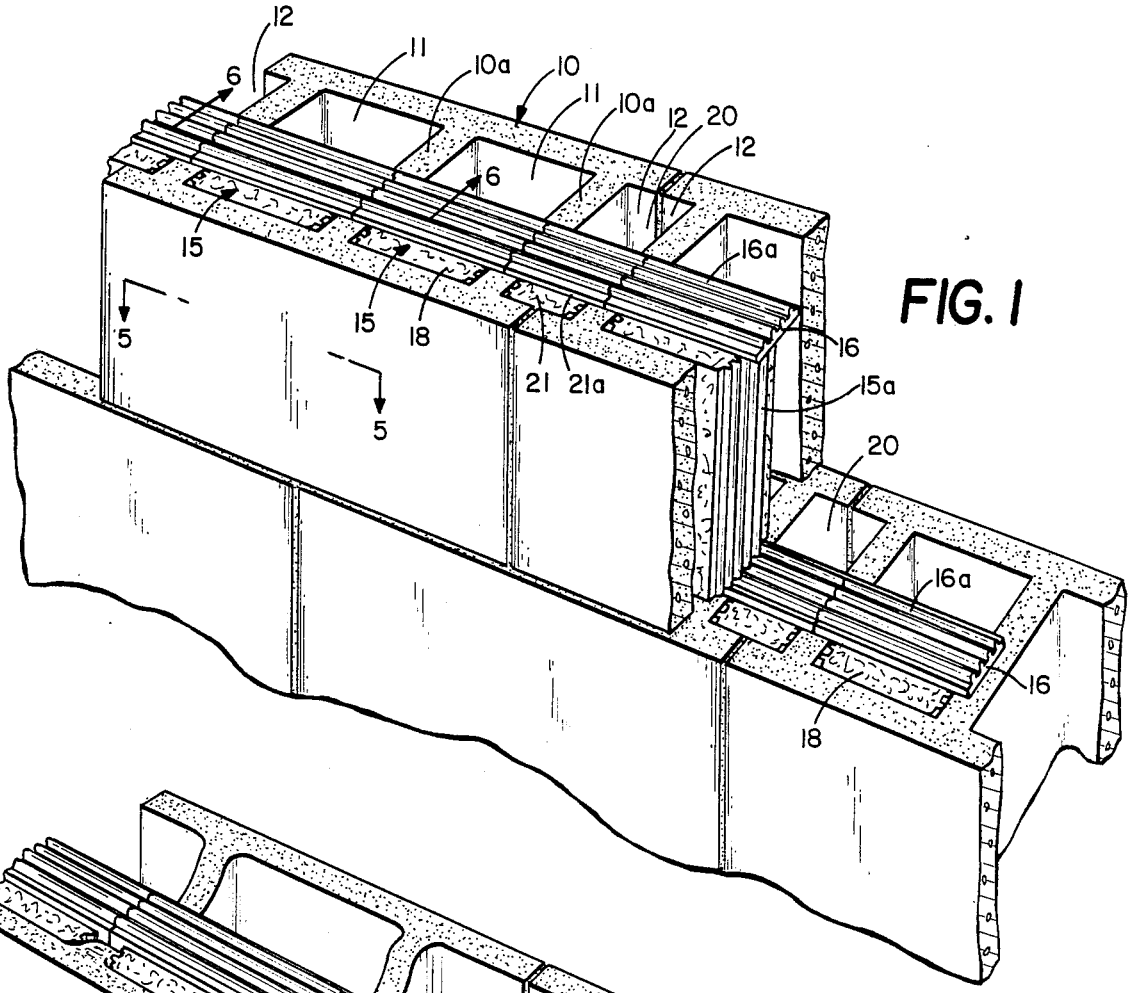
FIG. 1 is a perspective view showing one form of my block insulating system.
Figure 5:
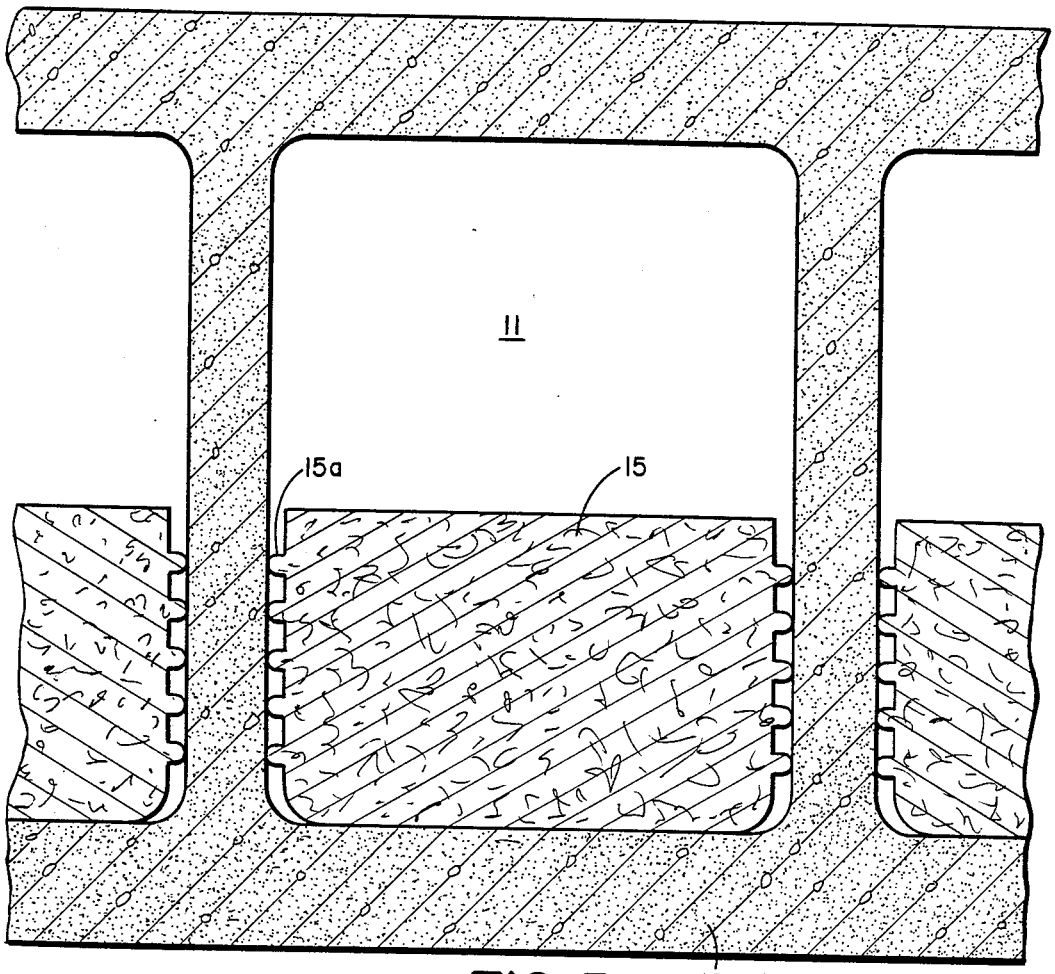
FIG. 5 is a horizontal sectional view of the form shown in FIG. 1.
Figure 6:
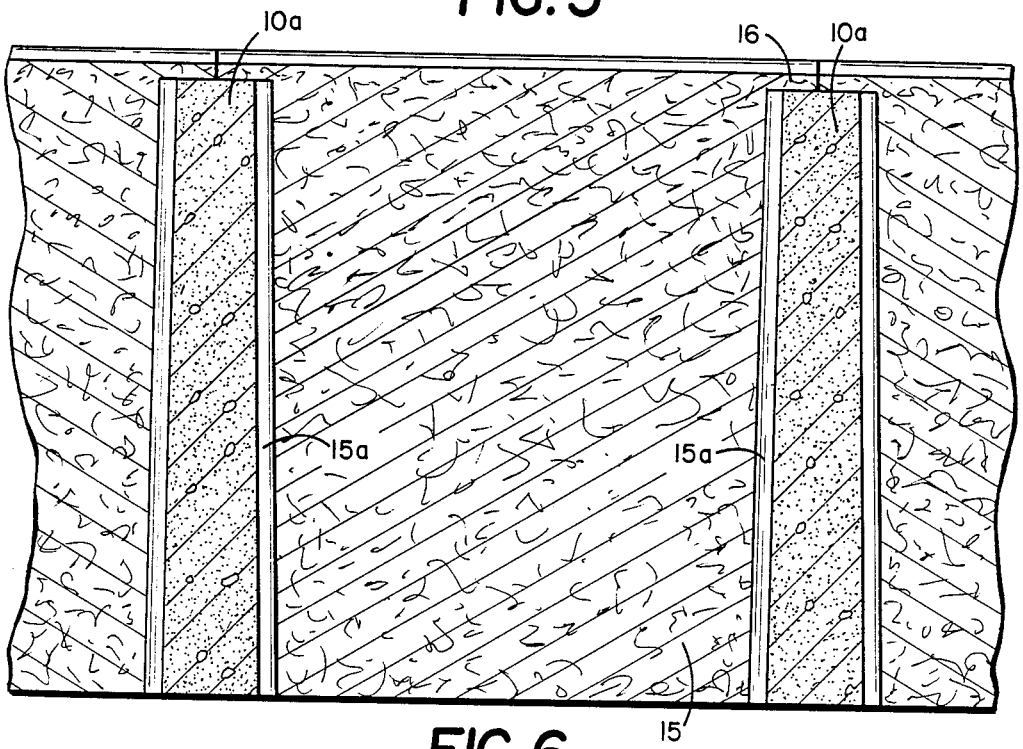
FIG. 6 is a vertical section taken substantially along the line 6—6 of FIG. 1.
Figure 9:
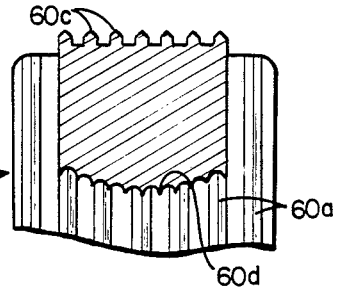
FIG. 9 is a vertical sectional view taken substantially along the line 9—9 of FIG. 7.

FIG. 1 illustrates a portion of a block wall embodying one form of the invention. Each of the blocks 10 shown in this form of the invention is provided with two cavities 11 and a pair of recesses 12 at the ends thereof. An integrally formed insulating insert unit is provided for each of the cavities 11 and has a body 15 which, in the form shown, is tapered to diminish toward the lower ends thereof to conform to the taper of the cavities 11 as illustrated in FIG. 1. Webs **10*a* form the tapered cavity walls and the upstanding side edges of each insulating insert are provided with a plurality of parallel, spaced-apart side crush ribs 15*a* as best shown in FIGS. 1, 5 and 6 to provide a more positive gasket-type seal between the side wall surfaces of the cavities 11 and the body 15. These crush ribs 15*a* are actually crushed against the side walls 10*a* of block cavities 11. Each body 15 is provided with integrally-molded top capping flange 16 which extends above he upper surfaces of the blocks 10 as best shown in FIGS. 1 and 6, and a plurality of spaced-apart top crush ribs 16*a* are provided on the top surface of each flange 16** and provide a gasket-type seal with the bottom of the adjacent upper block layer.

The body 15 has a front surface designed to be positioned adjacent to the inside wall of the cavity 11 as shown in FIGS. 1 and 5 and the top capping flange 16 is somewhat narrower than the width of the body 15 to form a recess shelf 18 which provides an overflow reservoir into which excess mortar flows when the upper ros of blocks is placed on the layer of mortar which has been trowled onto the top of the lower row of blocks. Also, the capping flange 16 is longer than the body 15 as shown in FIGS. 1 and 6 to overlie the adjacent block webs **10*a* as shown and to abut the end of the capping flange 16** of the insert unit adjacent thereto.

In this form of the invention, the end recesses 12 of each block combine with the end recesses 12 of adjacent blocks to form an end cavity designated by the numeral 20 which is not as wide as the main cavities 11. The construction of the unitary barrier insert unit is similar in all respects including the ribs and top capping flange, except that the width thereof is less than the width of the main insert units. The ribbed body of smaller barrier member is designated by the numeral 21 and the ribbed capping flange thereof is designated by the character 21*a*.

Figure 3:
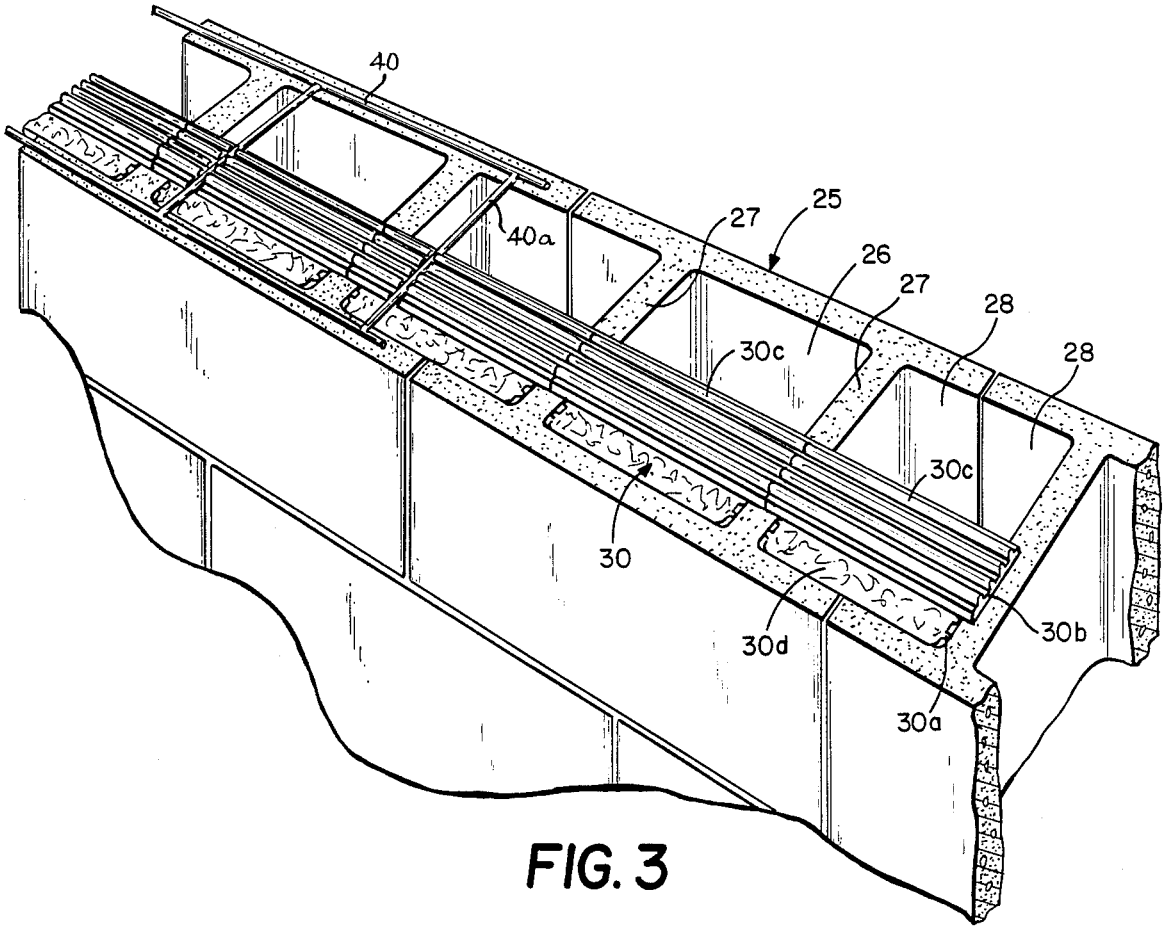
FIG. 3 is a similar view showing a modification of the form shown in FIG. 1.

The second form of the invention is shown in FIG. 3 which illustrates a block designated by the numeral 25 having a single cavity 26 formed between tapered webs 27. The end recesses 28 in the blocks 25 are slightly less than half the width of the recesses 26 so that when two blocks are laid end-to-end with mortar therebetween, the recess formed by the two adjacent end recesses 28 will be the same as the width of the single recess 26 as illustrated in FIG. 3. An insert unit for this block construction is of similar construction to that previously described in the form of the invention illustrated in FIGS. 1, 5 and 6, and includes a body 30 with side crush ribs 30*a*, a top capping flange 30*b* with crush ribs 30*c*, and a mortar-receiving shelf 30*d*. With this single cavity block 25, only one size insert unit is required to provide the insulating barrier for an entire block wall. Also shown in this form of the invention is a typical joint-reinforcing steel rod structure 40 with cross members 40*a*which obviously can be used with all forms of the invention. The yieldable material of the insulating insert member and the crush ribs 38*c* permits the steel to be pressed down toward the top surface of the lower block layer as shown in FIG. 3 to provide reinforcement between adjacent block rows as desired.

Figure 2:
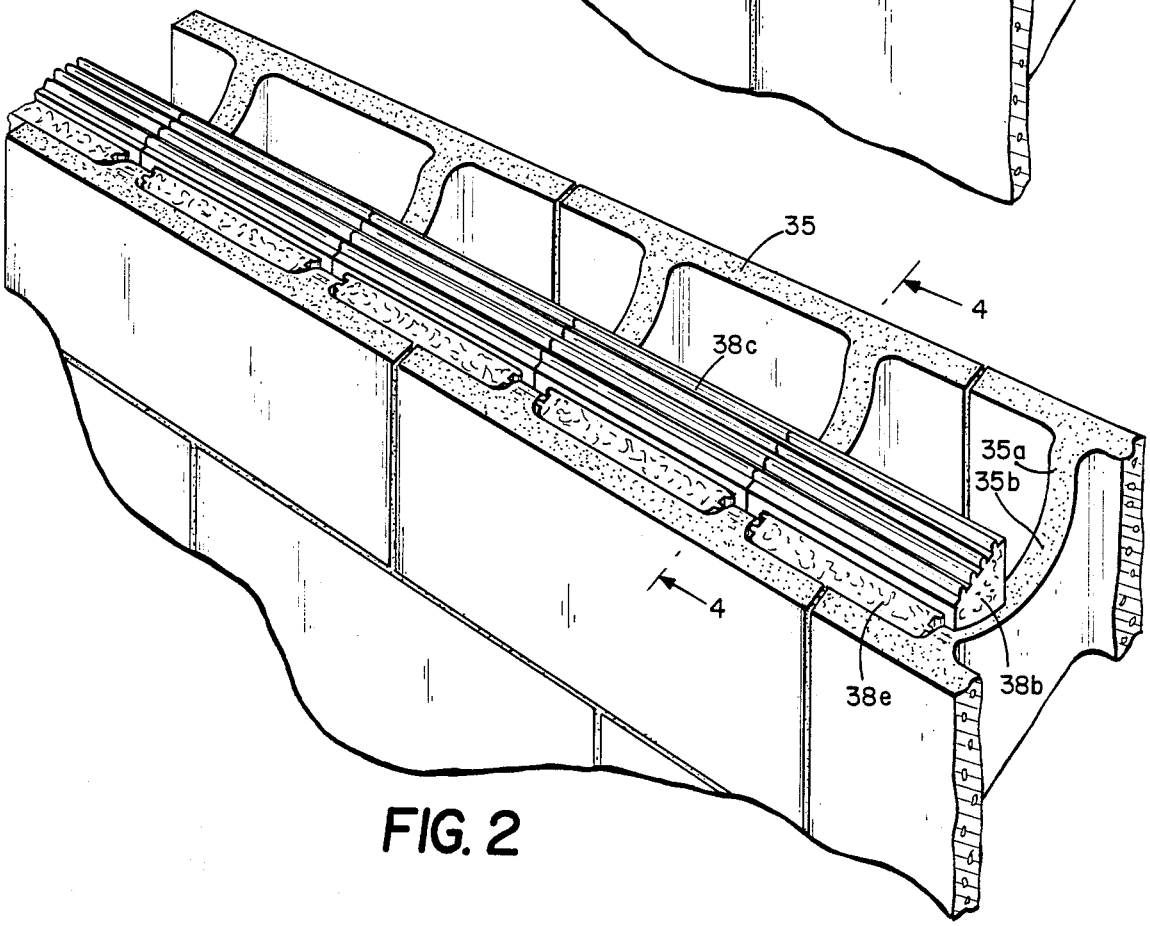
FIG. 2 is a similar view showing an alternative form thereof.
Figure 4:
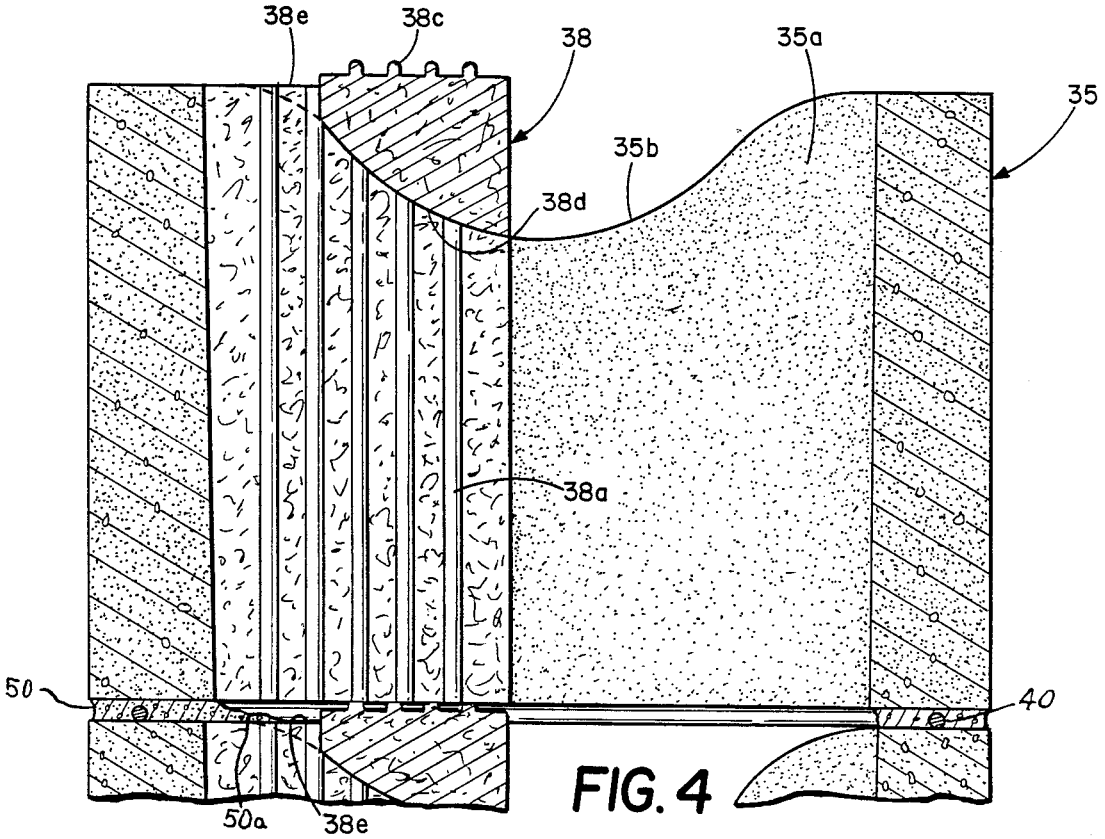
FIG. 4 is a transverse vertical section of the form shown in FIG. 2 and taken substantially along the line 4—4 of FIG. 2.

A third form of the invention is shown in FIGS. 2 and 4 which illustrates a single cavity block 35 wherein the cross webs 35*a* are provided with a recess 35*b*. The insert unit provided in this form of the invention has a main body 38 provided with upstanding sides having sealing crush ribs 38*a*. The top capping flange designated as 38*b* is thicker than the capping flange 30*b* previously described and has top ribs 38*c*. The lower edge of the end portions of the capping flange 38*b*is designated 38*d* and is curved to conform to the curvature of the recesses 35*b* formed in the block webs 35*a*. A mortar shelf 38*e* is provided along the edge of the top capping flange 38*b* as shown in FIGS. 2 and 4. FIG. 4 shows a layer of mortar 50 with the excess mortar designated by the numeral 50*a* extruded or pushed into the reservoir area formed onto the shelf 38*e*.

Figure 7:
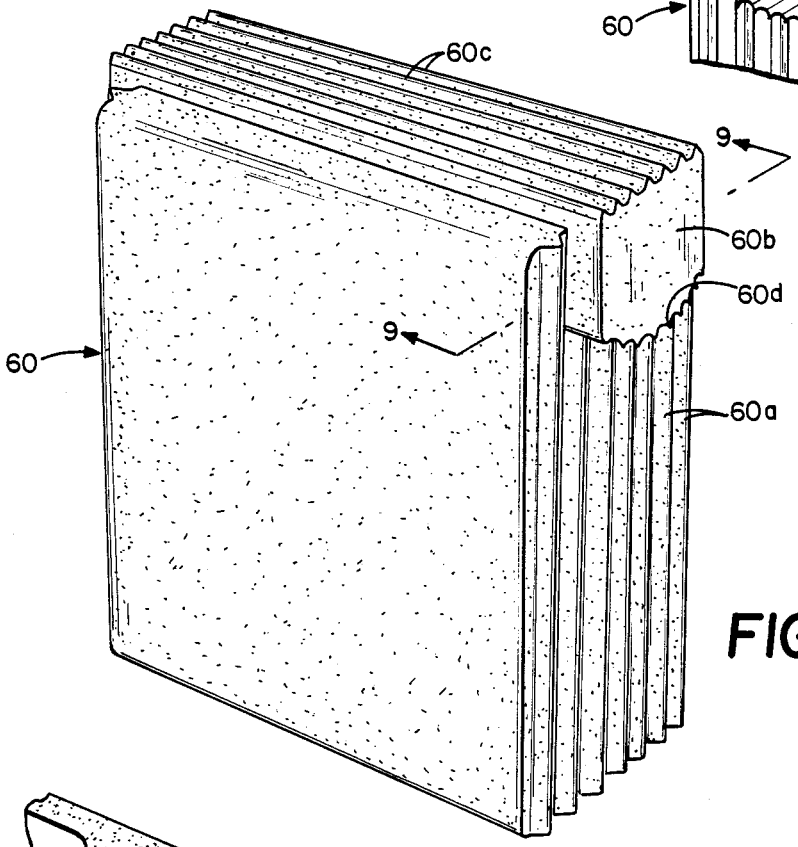
FIG. 7 is a perspective view of an insert embodying still another form of the invention.
Figure 8:
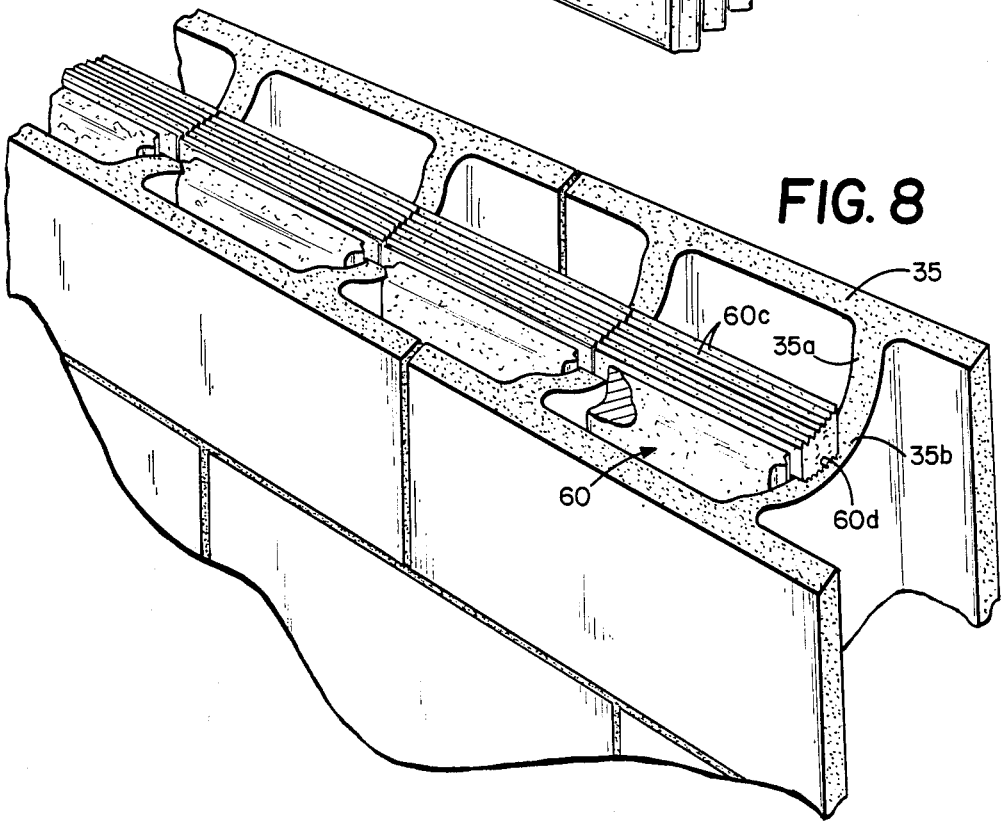
FIG. 8 is a perspective view of the insert shown in FIG. 7 embodied in a block wall.

Still another form of the invention is illustrated in FIGS. 7 and 8. In this form, an insulating body 60 is provided, particularly adapted for insertion in the center of the block cavity instead of adjacent the inner or outer wall of the cavity as is shown in the prior forms of the invention illustrated. The body 60 is provided with upstanding sides which are slightly tapered to conform to the taper of the block cavity, and the crush ribs 60*a* are provided to form a positive seal with the adjacent surfaces of the block webs in spite of variations in the cavity dimensions. The integrally formed capping flange 60*b* is generally symmetrical with respect to the longitudinal edges of the body 60. The end portions of the capping flange 60*b* extend longitudinally beyond the side crush ribs 60*a* and are centered on the upper portions of the sides of the body 60. The top of the capping flange is provided with crush ribs 60*c* which extend the full length thereof. The bottom edge of the extension of the capping flange is also provided with crush ribs 60*d*. As shown in FIG. 8, the building blocks are generally similar to the blocks 35 illustrated in FIG. 2 and are provided with webs 35*a* having a recessed top edge portion 35*b*. The crush ribs 60*d* define the same general radius of curvature as block recess 35*b* to sealingly engage the curved surface thereof as best shown in FIG. 8. The height of the insert insulating body 60 from the bottom surface thereof to the top of the crush ribs is approximately equal to the distance defined by the vertical depth of each block 35 plus the thickness of the mortar joint therebetween, so that as the blocks are laid up on the row therebelow, the crush ribs 60*c* will sealingly engage the bottom surface of the insert body 60 disposed thereabove and the crusability of the ribs will provide for reasonable variations in the height of each course of blocks while still producing the necessary seal with the adjacent upper course of blocks including the bottom surfaces of the insulating bodies 60 and the bottom surfaces of the cross webs 35*a* of the adjacent upper blocks.

It will be seen that all forms of this invention provide a unitary insulating insert unit for a number of different block configurations. The unitary insert construction greatly facilitates on-the-job installation and permits usage block configurations such as are shown in FIGS. 1, 5 and 6 and FIG. 3, as well as the block configuration embodied in block 35 as described.

The top capping flange integrally formed with the body portion of each form of the insulating insert unit not only provides a continuous barrier strip between adjacent rows of blocks, but also specifically limits the depth of insertion of the body portion into its cavity by engaging the top of the adjacent web portions. The depth of the body portion for each form of the invention is the same as the thickness of the blocks so that the bottom surface of the body portion combines with the bottom surface of the adjacent web portion of the block to produce a continuous horizontal bottom sealing surface for each row of blocks. This bottom sealing surface sealingly engages the continuous top sealing surface formed by the top capping flanges of the units inserted into the blocks of the adjacent row disposed therebelow. It will be noted that the crush ribs are designed to provide for a sealing engagement with the adjacent sealing surfaces regardless of the normal variations in the dimensions of the block cavities as well as variations in the thickness of the mortar layer and permits the block layer workman to vary the thickness of the mortar joint as may be necessary from time to time. It will also be noted that the thickness of the capping flange for each form of the invention forms a gauge for the block layer to facilitate the block laying operation.

It is to be understood that while there has been illustrated and described certain forms of the present invention, the invention is not to be limited to the specific form or arrangement of parts herein described and shown except to the extent that such limitations are found in the claims.

What is claimed is:

1. An integrally formed insulating unit specifically constructed for insertion into each block cavity formed in a masonry block wall section, of the type which includes a plurality of masonry blocks each having spaced inner and outer wall portions, spaced cross web with top and bottom surfaces, each unit comprising, a main insulating body having upstanding side edges defining the length thereof to produce a sealing fit with the cavity side wall when inserted into a block cavity and having a depth substantially equal to the depth dimension of the cavity into which the body is inserted to combine with the bottom surface of the block webs to form a substantially continous horizontal bottom sealing surface, the upstanding side edges of the main body which define the length of the body being sufficiently yieldable to sealingly engage the wall surface of the cavity into which the unit is inserted in spite of dimensional variations in both the concrete block cavities and the length of the main body, a top capping flange integrally formed with the top of the main body and extending thereabove and having a portion extending longitudinally outwardly beyond at least one of the upstanding side edges of the body to provide a positive stop to limit the depth of insertion of the body into the cavity and overlie in sealing engagement the adjacent top web surface of the block and being of sufficient length and thickness to abut the edge of the adjacent copping flange and being sufficiently yieldable to produce a positive continuous seal with the continuous bottom sealing surface of the adjacent insulated block layer disposed thereabove in spite of the dimensional variations in both the concrete blocks and the insulating body units, and a plurality of spaced generally parallel crush ribs each having a generally tapered cross section and formed on the top surface of the capping flange and being sufficiently yieladable body to provide and a continuous seal with the continuous bottom sealing surface of the adjacent insulated block layer disposed thereabove.

2. The structure set forth in claim 1 and a plurality of spaced generally parallel crush ribs eaching having a generally tapered cross section and formed on the upstanding side edges of the main body and being sufficiently yieldable to provide sealing engagement with the wall surface of the cavity into which the body unit is inserted.

3. The structure set forth in claim 2 wherein the upstanding side edges of the main body with crush ribs thereon are tapered to conform to a tapered block cavity shape.

4. The structure set forth in claim 1 wherein the top capping flange extends longitudinally outwardly beyond both of said upstanding side edges of the body unit to overlie in sealing engagement the adjacent top web surfaces of the block on both sides of said insulating body and being of sufficient length to abut the end of adjacent capping flange to provide the continuous longitudinal insulating barrier between block layers.

5. The structure set forth in claim 1 wherein the main body is provided with a front surface adapted to conform to the front surface of a block cavity and the front edge of the capping flange being set back to provide a mortar-receiving shelf above the top marginal edge surface of the block body to receive excess mortar which is extruded inwardly when the next upper layer of blocks is applied.

6. The structure set forth in claim 1 and a reinforcing grid interposed between adjacent layers of blocks in a masonary block wall section, said reinforcing grid including longitudinally disposed members and cross-members, the tapered crush ribs formed on the top surface of the capping flange being sufficiently yieldable to permit the reinforcing cross-members to crush the engaged rib portions and permit sealing contact between the ribs and bottom of the adjacent row of blocks disposed thereabove.

* * * * *